US005928086A

United States Patent [19]

Strickland

[11] Patent Number: 5,928,086

[45] Date of Patent: Jul. 27, 1999

[54] CHILD'S ADJUSTABLE ELEVATED SANDBOX APPARATUS

[76] Inventor: Joan Ruth Strickland, 630 Shadylawn, La Porte, Tex. 77571-7252

[21] Appl. No.: 08/986,690

[22] Filed: Dec. 8, 1997

Related U.S. Application Data

[51] Int. Cl.[6] ..... A63G 31/00

[52] U.S. Cl. ..... 472/126

[58] Field of Search ..... 472/126, 134, 472/135, 137; 482/51; 297/344.12, 256.11

[56] References Cited

U.S. PATENT DOCUMENTS

| | | | |
|---|---|---|---|
| 2,540,206 | 2/1951 | Levitin | 297/256.11 |
| 4,045,019 | 8/1977 | Wade | 472/126 |
| 4,901,998 | 2/1990 | Griffith | 472/126 |

*Primary Examiner*—Kien T. Nguyen
*Attorney, Agent, or Firm*—Todd A. Bynum

[57] ABSTRACT

An elevated sandbox that can be practiced utilizing multiple themes, and having the capability of adjusting to the height of different children. The present invention is practiced utilizing four major components; a base, height adjusting sections, a sand container, and a ledge capable of supporting various sand toys. The base is substantially circular in shape about a center axis and includes a lower section and an upper section The upper section interfaces with a height adjusting section or the sand container. The lower section of the base includes multiple support feet to provide stability for the apparatus when assembled and in use. A height adjusting section formed to cooperatively mount on the base section or to other height adjusting sections is used to adjust the height of the apparatus to allow positioning for the height of a particular child. The sand container includes a lower section which is substantially circular about a center axis and includes a plurality of support brackets that provide support for the ledge. A ledge capable of supporting various toys is integrally attached to, and forms a coaxial ring around the sand container.

4 Claims, 2 Drawing Sheets

CHILD'S ADJUSTABLE ELEVATED SANDBOX APPARATUS

BACKGROUND OF THE INVENTION

1. Field of the Invention

The present invention relates generally to yard toys and in particular to sandboxes including a table top sandbox.

2. Description of the Related Art

Sandboxes and table top yard toys are known in the art. Patents found relating to, yet distinguished from, the present invention are "Combination Table, Sandbox or Wading Pool", U.S. Pat. No. 3,006,705; "Child's Playpen and Sandbox Device", U.S. Pat. No. 3,454,272; "Play Enclosure for Artwork, Paperwork, Sand and Water Play Use", U.S. Pat. No. 4,901,997; and "Multi-functional Activity Table", U.S. Pat. No. 4,901,998.

U.S. Pat. No. 3,006,705 teaches a table that can be configured to hold sand or water. This patent does not teach a tabletop sandbox. U.S. Pat. No. 3,454,272 teaches a sandbox mounted above ground level in combination with an adjustable seat therein. U.S. Pat. No. 4,901,997 is for a combination sandbox and activity box. This patent is only relevant to the extent that it is a multifunctional sandbox. Finally, U.S. Pat. No. 4,901,998 teaches a tabletop multifunctional table that could be used as a tabletop sandbox. In this configuration, there is a method by which the table can be adjusted between two heights.

SUMMARY OF THE INVENTION

The present invention provides a safe and enjoyable play apparatus for children which includes a play medium such as sand or dirt held at chest level on a table top supported by an adjustable base. The base includes adjusting sections thereby allowing height adjustment of the table top to chest height for multiple children or for continued use by a single child for years as the child grows. The invention allows the child to play for hours in the chosen medium while minimizing medium contact with the body and clothes.

DETAILED DESCRIPTION OF A PREFERRED EMBODIMENT OF THE INVENTION

Figure 1:
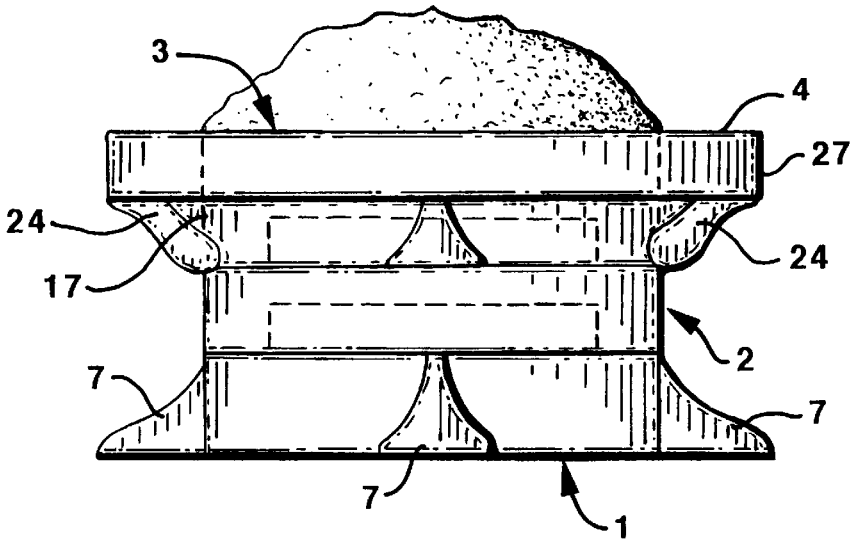
FIG. 1 is a frontal view of the assembled invention including sand.

The present invention is an elevated sandbox that can be practiced utilizing multiple themes. A theme is created by the selection accessory toys and the aesthetic characteristics chosen for the particular embodiment. The preferred embodiment of the present invention depicted in FIG. 1 is practiced utilizing four major components; a base (1), height adjusting sections (2), a sand container (3), and a ledge (4) capable of supporting various sand toys. Once assembled the apparatus may resemble a tree wherein the base and height adjusting sections are molded to form the trunk of the tree and the sand container represents the branches. Once the apparatus is assembled, sand (23) or another substance suitable for child play is placed in the sand container (3). A child or multiple children stand or sit around the perimeter of the apparatus to play with the sand and any toy placed on the ledge (4). One of the most appealing aspects of this unique apparatus is that the child does not get completely involved with the sand in the apparatus making cleanup less demanding.

Figure 2A:
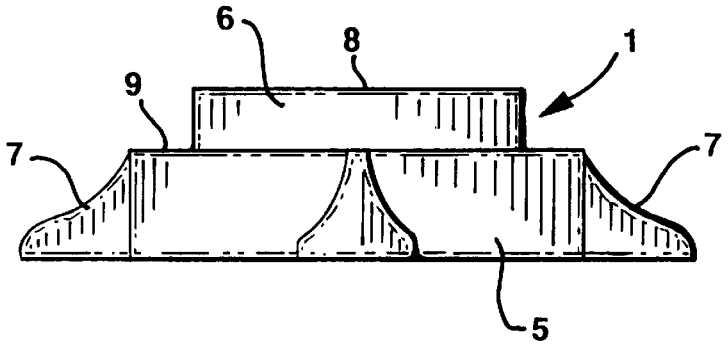
FIG. 2A is a frontal view of the base of the invention.
Figure 2B:
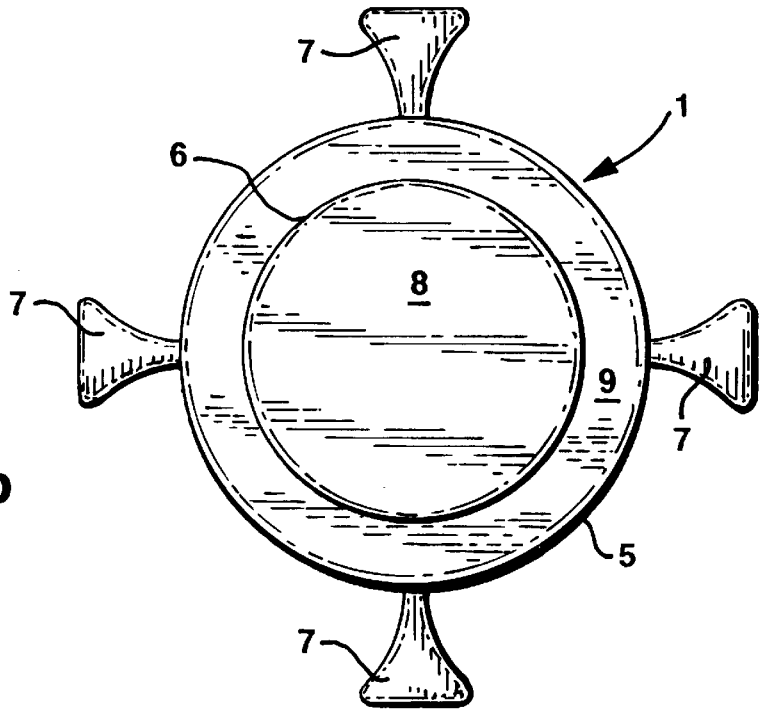
FIG. 2B is a top view of the base of the invention.

Referring to FIGS. 2A and 2B, the base (1) is formed utilizing materials suitable for molding and mass production. The base is substantially circular in shape about a center axis and includes a lower section (5) and an upper section (6). The upper section has a radius less than the radius of the lower section and extends above the lower section to provide a suitable interface with a height adjusting section (2) or the sand container (3). The upper section includes a top surface (8) lying in a plane parallel to a surface (9) which forms the top of the lower section of the base.

On the lower section of the base are located multiple support feet (7) to provide stability for the apparatus when assembled and in use. The main purpose of the support feet is prevent the overturning of the table when a child attempts to climb onto the sandbox. Each support foot (7) is integrally attached to the lower section of the base and extends in a direction outwardly from the center axis to a distance at least equal to the radius of the sand container (3) and toy ledge (4) combined.

Figure 3A:
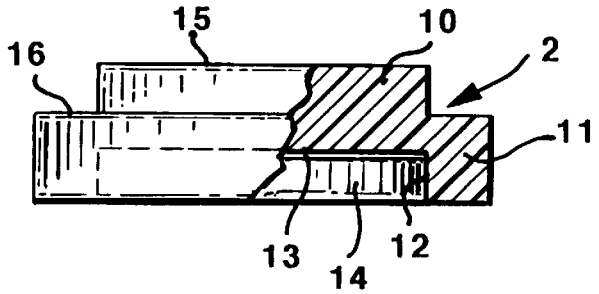
FIG. 3A is a frontal view of the height adjusting section of the invention.
Figure 3B:
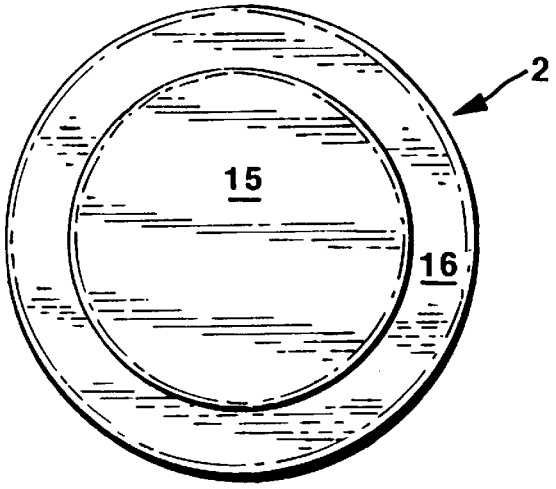
FIG. 3B is a top view of the height adjusting section of the invention.

FIGS. 3A and 3B show a height adjusting section (2) formed to cooperatively mount on the base section. The present invention is intended to include a plurality of these height adjusting sections to allow a comfortable playing height for a wide range of child size. Additionally, this method of mounting allows for easy assembly and disassembly. Each height adjusting section is formed to be substantially identical to the other height adjusting sections. Each height adjusting section is substantially circular in shape about a center axis and includes a lower section (11) and an upper section (10). The upper section has a radius less than the radius of the lower section and extends above the lower section to provide a suitable interface with another height adjusting section (2) or the sand container (3). The upper section includes a top surface (15) lying in a plane parallel to a surface (16) which forms the top of the lower section of the base. The lower section provides a cavity (14) defined by a perimeter wall (12) and a top (13). The perimeter wall and top form a terminated cylinder about a center axis capable of receiving the upper section of the base or the upper section of another height adjusting section.

Figure 4A:
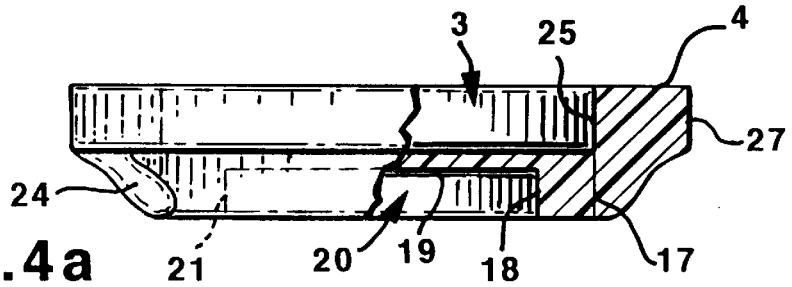
FIG. 4A is a frontal view of the sand container with the toy ledge attached.
Figure 4B:
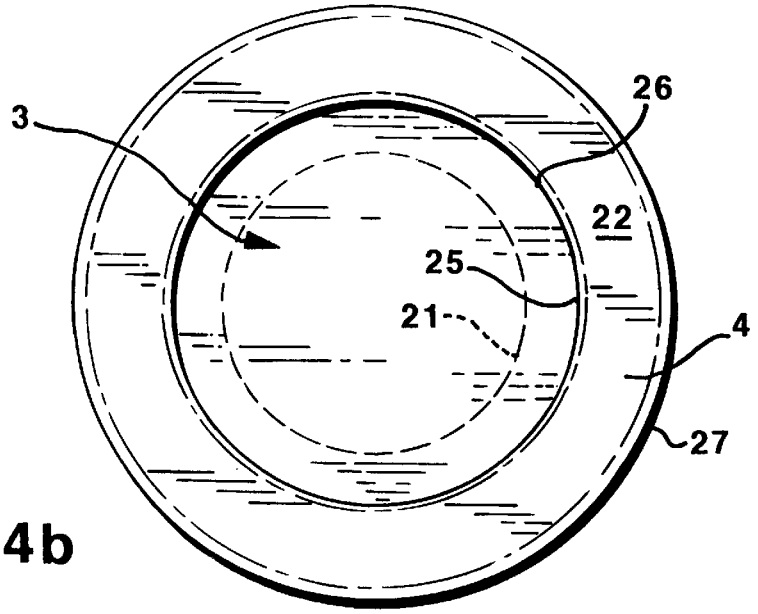
FIG. 4B is a top view of the sand container with the toy ledge attached.

Referring to FIG. 1, the sand container (3) includes a lower section (17) which is substantially circular about a center axis. The lower section includes a plurality of support brackets (24) that provide support for the ledge (4). Turning to FIGS. 4A and 4B, the lower section provides a cavity (20) defined by a perimeter wall (18) and a top (19). The perimeter wall and top form a terminated cylinder about a center axis capable of receiving the upper section (6) of the base (1) or the upper section (10) of a height adjusting section (2). The sand container is further defined by a cylinder formed by a circular bottom (21) and a cylindrical wall (25) about a center axis. A ledge (4) capable of supporting various toys is defined by an inner perimeter (26), an outer perimeter (27), and a play surface (22). The ledge is integrally attached to, and forms a coaxial ring around the sand container (3). The ledge is provided support by the plurality of support brackets (24) extending from the lower section (17) of the sand container.

What is claimed is:

1. A table top sandbox apparatus comprising:

a base having a lower section substantially circular in shape and an upper section substantially circular in shape and having a top surface and a substantially cylindrical wall extending above said lower section and having a radius less than the radius of the lower section;

a plurality of support feet integrally attached to said lower section of said base and extending outwardly from said lower section to provide stability for said sandbox;

a plurality of height adjusting sections each being capable of interfacing interchangeably in a cooperative relationship with the base and with the other height adjusting sections wherein said base or combination of said base and said height adjusting section is capable of supporting added height adjusting sections;

a sand container capable of receiving said base or a height adjusting section wherein said base or combination of base and height adjusting section is capable of providing support to said sand container;

a ledge integrally attached to said sand container and capable of supporting toys or other play items; and a play medium for sculpting and digging deposited in said sand container.

2. A tabletop sandbox as claimed in claim 1 wherein said height adjusting sections comprise:

a lower section substantially circular in shape having a cavity defined by a perimeter wall and a top surface, said perimeter wall and top forming a terminated cylinder about a center axis capable of receiving the upper section of said base or an upper section of another height adjusting section; and an upper section substantially circular in shape having a top surface and a substantially cylindrical wall extending above said lower section and having a radius less than the radius of the lower section to provide a suitable interface with another height adjusting section or said sand container.

3. A tabletop sandbox as claimed in claim 1 wherein said sand container further comprises:

a lower section substantially circular about a center axis having a cavity defined by a perimeter wall and a top, said perimeter wall and top forming a terminated cylinder about a center axis capable of receiving the upper section of said base or the upper section of said height adjusting section;

a plurality of support brackets integrally attached to said lower section; and a container defined by a cylinder formed by a circular bottom and a cylindrical wall about a center axis.

4. A tabletop sandbox as claimed in claim 1 wherein said ledge further comprises:

a substantially circular ring defined by an inner perimeter and an outer perimeter, said inner perimeter being integrally attached to said sand container; and a flat play surface located between said inner perimeter and said outer perimeter.

* * * * *